US005212529A

United States Patent [19]

Morris et al.

[11] Patent Number: 5,212,529

[45] Date of Patent: May 18, 1993

[54] HEAT AND PRESSURE FUSER

[75] Inventors: Daniel L. Morris; David A. Bartman, both of Webster; Albert E. Andrews, Rochester; Emilio J. Giuseppetti, Webster; Paul M. Achtziger, Ontario; Paul J. Rowe, Williamson; Donald L. Pease, Honeoye, all of N.Y.

[73] Assignee: Xerox Corporation, Stamford, Conn.

[21] Appl. No.: 888,949

[22] Filed: May 26, 1992

[51] Int. Cl.[5] ..... G03G 15/20

[52] U.S. Cl. ..... 355/290; 219/216; 355/285

[58] Field of Search ..... 355/282, 285, 289, 290, 355/295, 286, 287, 288; 219/216

[56] References Cited

U.S. PATENT DOCUMENTS

| | | | |
|---|---|---|---|
| 4,689,471 | 8/1987 | Pirwitz et al. | 219/216 |
| 4,822,978 | 4/1989 | Morris et al. | 219/216 |
| 4,859,831 | 8/1989 | Webb | 219/216 |
| 4,860,047 | 8/1989 | Pirwitz | 355/290 |
| 4,996,556 | 2/1991 | Gray, Jr. | 355/50 |
| 5,040,777 | 8/1991 | Bell et al. | 271/3 |
| 5,046,146 | 9/1991 | Bartman et al. | 219/216 |

*Primary Examiner*—A. T. Grimley
*Assistant Examiner*—Sandra L. Brasé

[57] ABSTRACT

A heat and pressure fuser includes a thin web which is wrapped around a portion of a heated fuser roll to form a fusing area. The web contacts the fuser over a relatively short wrap angle to reduce torque required to drive the fuser roll, thereby enabling a higher process speed. Fusing efficiency is maintained by use of a biasing mechanism which increases the pressure applied to the web both the entrance and exit areas of the fuser.

7 Claims, 4 Drawing Sheets

HEAT AND PRESSURE FUSER

This invention relates generally to heat and pressure fusing of toner images formed on a copy substrate and, more particularly, to the fusing of images in a fusing system incorporating a low mass heated fuser roller which cooperates with an elongated web member to create the fusing area.

It is known in the prior art to use a low mass fuser roll member which cooperates with an elongated web which is wrapped around a portion of the roll member and held in engagement therewith by a biasing member. The interface between the web member and the fuser roll form the fusing area through which the copy substrate sheets pass. A fusing system of this type is used in a commercial large document copying machine, the Xerox 2510 and disclosed in U.S. Pat. No. 4,689,471 assigned to Xerox Corporation. The contents of this patent are hereby incorporated by reference. As disclosed in the patent, a low mass heated fuser roll cooperates with an elongated web member comprising a woven fabric to form an extended fusing area. One end of the pressure web is fixed, while the other end is biased into pressure engagement with the fuser roll to form an entrance nip. The pressure web is an enabling feature of this type of system, but its effectiveness depends upon several factors such as the type of copy substrate media being used, relative humidity conditions, and the process speed of the system. As an example, certain types of copy media are subject to stalling or jamming on the leading edge entrance of the fuser entrance nip. The pressure and location of the web biasing means is, therefore, of critical importance.

In the fusing system disclosed in the '471 patent, a pressure web 72 is held in place against the surface of a low mass fuser roll 49 by a low pressure (about 6 pounds in the Xerox 2510) biasing mechanism 80 and by a blade member 82 biased against the entrance nip to apply a second low pressure (6 pounds). The efficiency of the fusing system, however, is proportional to the process speed of the system; as the process speed increases, the demands on the fusing system increase. It has been found that at process speeds greater than 2.0 ips (inches per second), (the speed of the 2510 machine), the biasing forces, including the pressure applied by the biasing blade member, must increase to accomplish an acceptable fusing fix of the copy substrate sheet, as it passes through the web-fuser roll contact area. However, attempts to increase the biasing forces produced higher levels of torque to drive the fuser roll. Heretofore, this increased torque has been a limiting factor in increasing process speeds of large document copiers, such as the 2510.

It is therefore an object of the present invention to enable high fusing rates without increasing the torque levels of the fuser roller. This object is realized by reducing the contact wrap area between the web and the fuser roll, while using two flexible blade members to apply pressure to the web at both ends of the wrap angle. More particularly, the present invention is directed towards a heat and pressure fusing system for fusing a toner image on a copy sheet having a leading and trailing edge comprising:

a rotatable heated fuser roll, a thin web in pressure contact with the fuser roll along a wrap angle area, said wrap angle area defining the area in which the toner image is fused, and web biasing means for maintaining the web in contact with the roll surface at at least two pressure differentials along said wrap angle area.

Figure 1:
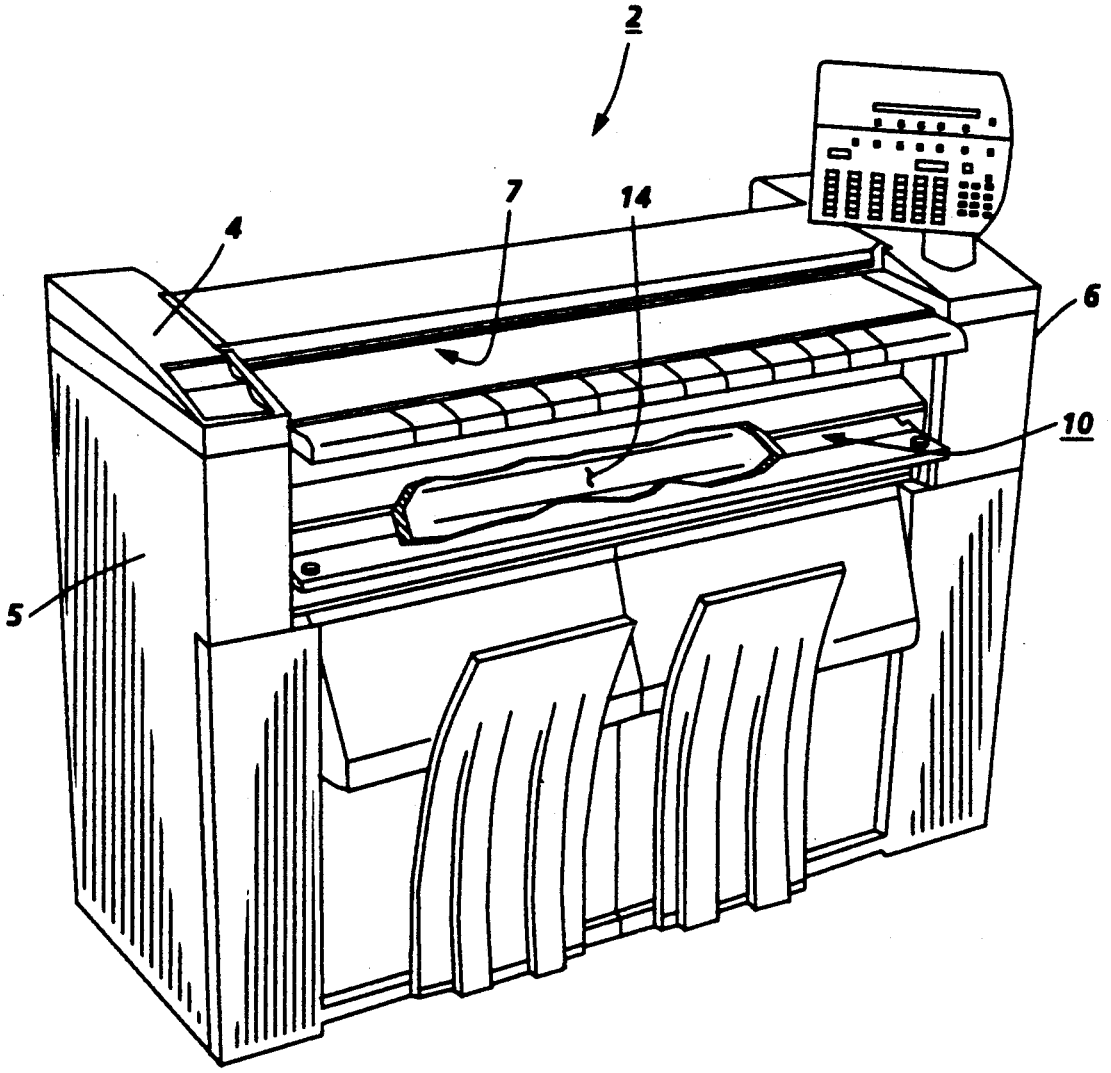
FIG. 1 is a front perspective view of one embodiment of a copying machine incorporating the heat and pressure fusing system of the present invention.

FIG. 1 shows a front perspective view of a large document copier 2, which incorporates the improved heat and pressure fuser of the present invention. The copier 2 includes a housing frame 4, having panels 5 and 6, which enclose the sides of frame 4. Documents are fed into an entry nip 7, either by a constant velocity transport (CVT) feeder or manually by an operator. Located within the frame 4 are xerographic subassemblies used to create an output copy of the original document. These include an exposure station to form an electrostatic latent image of the document on the surface of a photoreceptor drum; a charging station to charge the surface of the drum; a developing station to develop the latent image; a transfer station to transfer the developed image to a copy sheet and a fusing station to fuse the transferred image. The fusing station incorporates the heat and pressure fusing system 10 of the present invention. Further details of an exemplary system in which these subassemblies and the fusing system of the present invention can be utilized are disclosed in U.S. Pat. Nos. 5,040,777 and 4,996,556, whose contents are hereby incorporated by reference. The fusing system 10 includes an elongated fuser roll 14, located within machine frame 4, as shown in the cutaway view.

Figure 2:
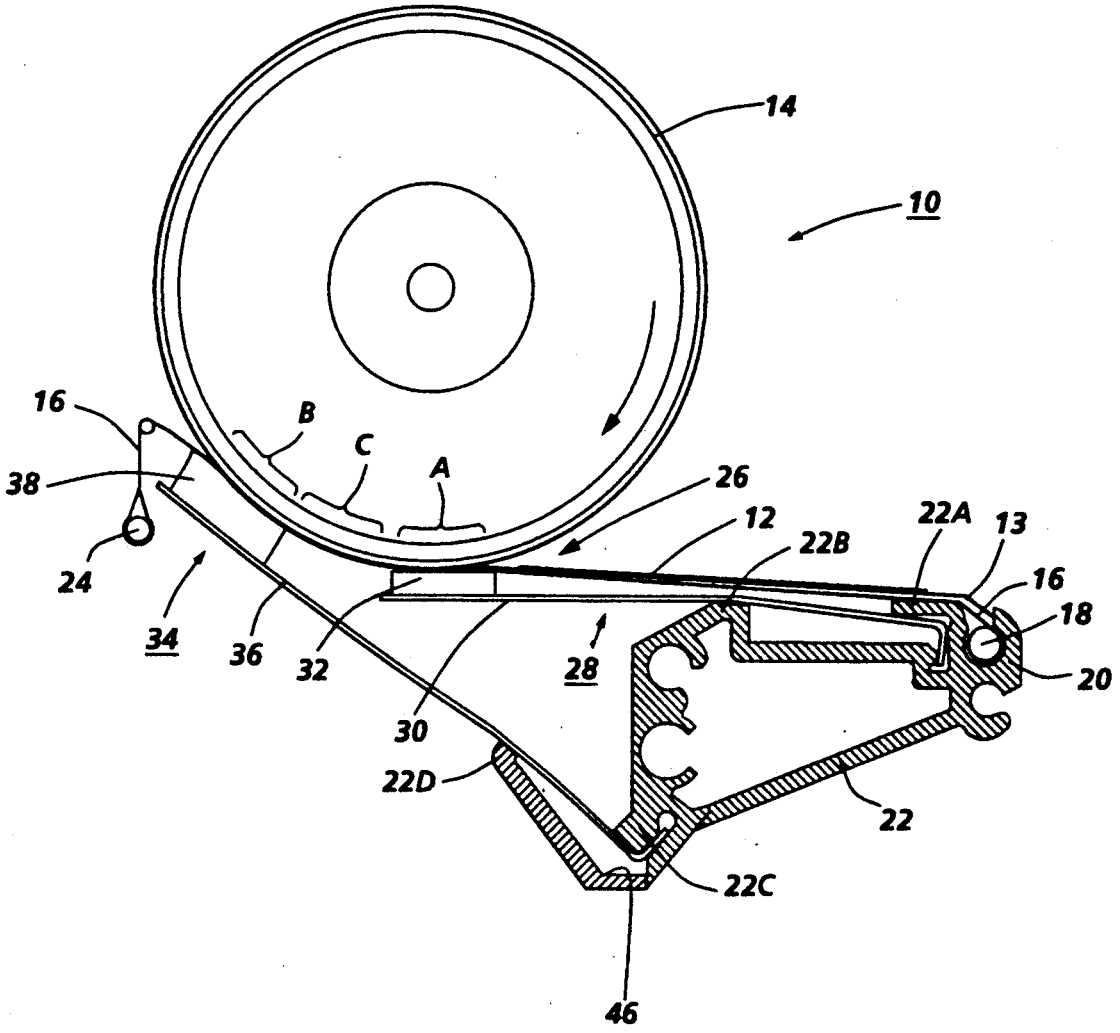
FIG. 2 is a side schematic view of the heat and pressure fusing system of FIG. 1.
Figure 3:
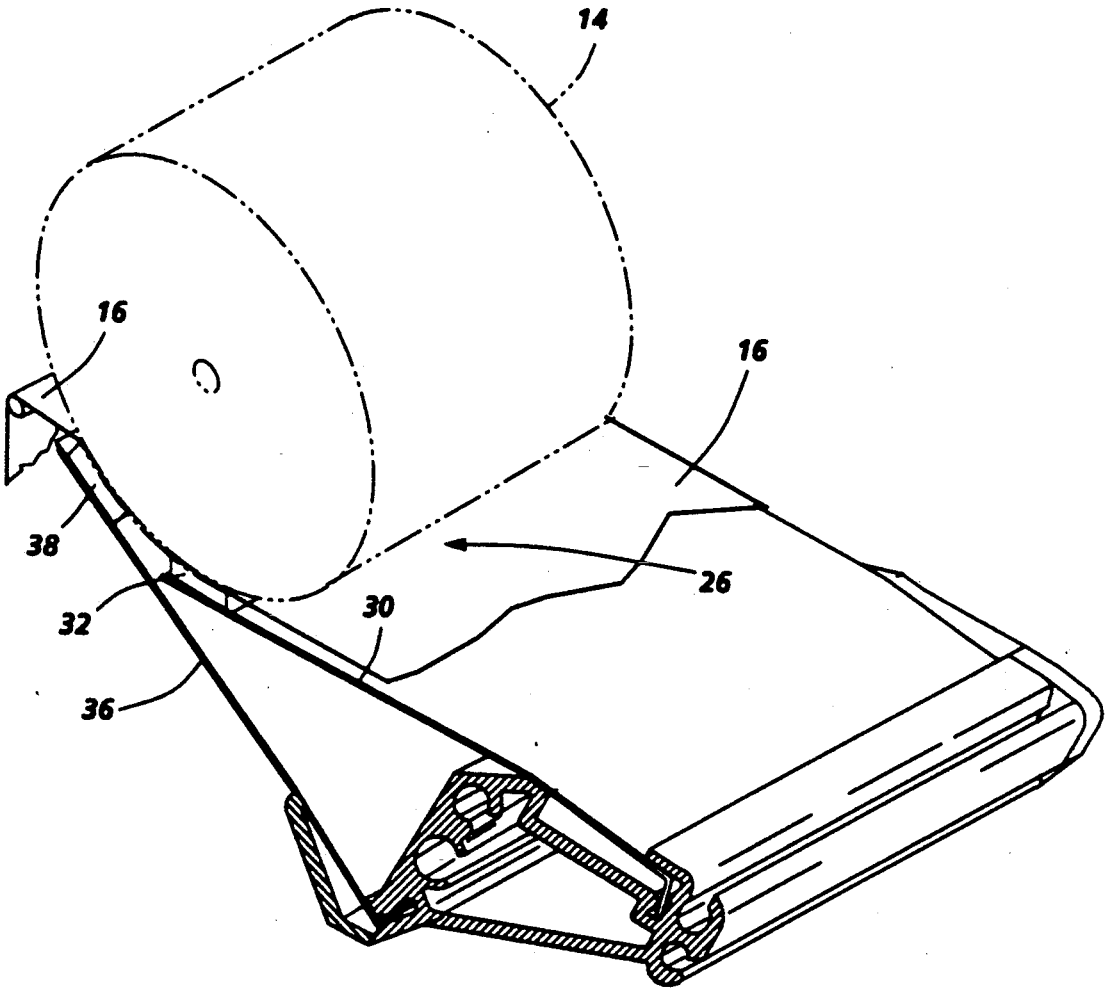
FIG. 3 is a top perspective view of the heat and pressure fusing system of FIG. 1.

Referring now to FIGS. 2 and 3, these show a side view and a partial top view, respectively, of fusing system 10, with the covers removed. A copy sheet 12 bearing a transferred toner image is shown moving in the indicated direction along the surface of guide member 13. It is understood that the fusing system has a length into the page, all components of the system likewise extend into the page and are commensurate in length with the fuser roll. System 10 includes fuser roll 14 comprising a thin-walled thermally conductive tube having a thin (i.e. approximately 0.005 inch (0.01 Centimeters) coating of silicone rubber on the exterior surface thereof, which contacts the image on the copy substrate 12 to thereby affix the image to the substrate. Fuser roll 14 is heated conventionally by an internal heating source, typically a quartz lamp. A release agent management system, not shown, applies a thin layer of silicone oil to the surface of the fuser roll for the prevention of toner offset thereto, as well as reducing the torque required to effect rotation of the fuser roll. In one operative embodiment of the fuser roll, its diameter was 3.3 inches and its length 40 inches. This embodiment is typically used to fuse images on copy substrates that are 3 feet (0.91 meters) wide by 4 feet (1.22 meters) in length. Fuser roll 14 rotates in the direction of the arrow.

Wrapped around a portion of the fuser roll surface is a pressure web 16. Web 16 comprises a woven fabric made from heat resistant material. In the preferred embodiment, web 16 is an air-blown Teflon-coated fiberglass.

One end of web 16 is wrapped around rod 18, which is anchored in cavity 20 of frame structure 22. The opposite end of web 16 is wrapped around rod 24. The copy sheet entrance nip 26 is defined by the surface of roller 14 and a first biasing member 28 comprising a flexible blade 30 having a silicon rubber pad 32 attached to the surface contacting the fuser roll. Blade 30 is flexed between points 22A, 22B of frame 22 to provide a pressure along an area A, in a preferred embodiment, of 18 pounds. As shown, the blade member 30 and segment 32 are mounted tangentially to the fuser roll 14 surface, biasing web 16 against the fuser roll surface and enhancing the leading edge entry of sheet 12 into the nip area.

Continuing with the description of fusing system 10, a second biasing member 34 comprises a second blade 36 having a silicone, high temperature, foam rubber pad 38 contacting the fuser roll at the exit end of the wrap angle. Pad 38 is in contact with the fuser roll surface along approximately 25° of the total wrap angle of 52°. The pad 38 provides a thermal barrier between the fuser roll, web and blade, thereby reducing thermal migration into the paper and improving thermal stability. Pad 38 also adds compression to web 16, enlarging the contact area and enhancing conformity of the web to the slightly irregular surface of the fuser roll, thus making the fusing more uniform. The pad also aides in absorbing blade 36 deformations. Blade 36 is flexed between points 22C, 22D to provide a pressure of approximately 18 pounds along area B.

The arrangement shown in FIGS. 2 and 3 has several features which enable a fusing process at higher process speeds: e.g. the Xerox 2510 process speed was 2.0 ips, while the present embodiment has been demonstrated to provide the requisite fixing at speeds of up to 3.0 ips. A first feature is the relatively shorter wrap angle (contact area between web 16 and the fuser roll surface) compared to the prior art. A wrap angle of approximately 57° is used compared with 70° in the prior art. This shorter wrap angle greatly reduces the "band break" effect; e.g. a greater wrap angle exerts pressure against contacted area of the fuser roll proportionate to process speed, thereby increasing the torque requirements for driving the fuser roll. A smaller wrap angle results in less torque. The overall torque on the fuser roll is also reduced by using, for web 16, an air-blown Teflon-glass material, which is permeable and presents less total surface acting against the fuser roll, thereby decreasing the frictional torque. Because of the shorter wrap angle, however, the fusing efficiency must be enhanced so that the toner images are properly fused before exiting the fuser area. This is accomplished by providing increased pressure along areas A and B, by action of biasing members 28 and 34. The increased pressure along areas A and B accelerates the fusing process and compensates for the shorter fixing time resulting from the shorter wrap angle. An optimum pressure range has been found to be between 14 and 22 lbs.

In operation, the leading edge of sheet 12 enters the entrance nip 26 and is engaged between rotating roll 14 and pad 32. The toner image is immediately subjected to an enhanced fusing as it passes over the width of pad 32, due to the pressure applied by member 28. As the copy sheet 12 travels through area C, it is subjected to a lower fusing pressure resulting from frictional forces between the web surface and the roller surface and by the nature of the web, as well as the resultant forces applied by biasing members 28, 34. When the lead edge of sheet 12 reaches the enhanced pressure area B, it is subject to the enhanced fusing over the width of pad 38, applied by action of blade 36. Copy sheet 12 emerges with the toner image fully fixed and is deposited on output tray 40.

It is seen from the above that the web experiences a biasing pressure differential along its length. There is a greater bias provided along areas A and B, than along area C. The fusing pressure at areas A and B is set at the 18 pounds applied by the two blade members 30, 36. Since the fusing pressure between areas A and B (along area C) is at a second lower pressure, a pressure differential exists across the wrap angle area of the web.

Figure 4:
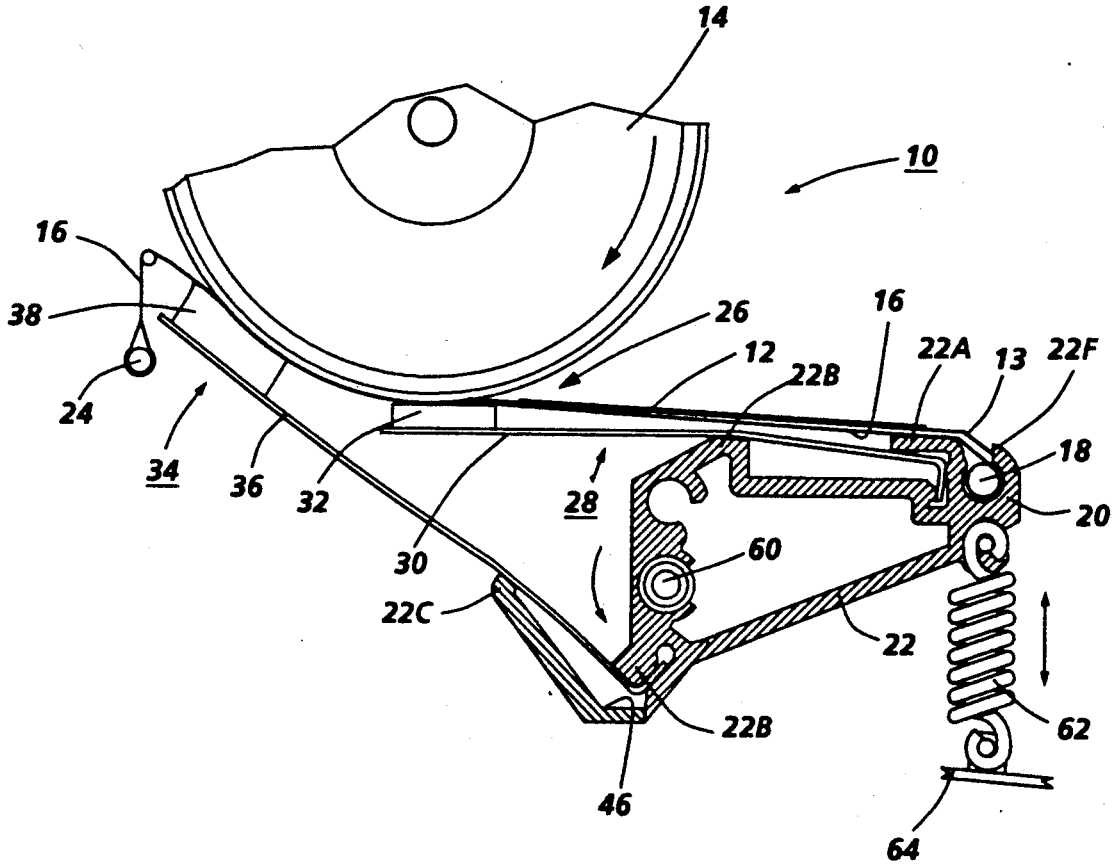
FIG. 4 shows an alternate embodiment of the fusing system of FIG. 1.

According to another aspect of the present invention, it is desirable to limit the fuser roll drive torque to a maximum known value. This is accomplished, as shown in FIG. 4 embodiment, by setting a spring force that resists the pivoting nature of the fuser blade mounting extrusion. In this alternative embodiment, frame structure 22 is mounted so as to be pivotable about point 60. A spring 62 with a predetermined extension force is connected between a fixed point 64 and pivoting extrusion 22F. Extrusion 22F will pivot in a counterclockwise direction when the coefficient of friction at the web/roll interface (torque) begins to increase. When the extrusion pivots, the normal force of the fuser blade is reduced and the drive torque is lessened. Spring 62 is set so that the pivoting motion is constrained to within the extension range of the spring. This system is passively driven by the frictional forces which exist in the wrap angle area.

While the invention has been described with reference to the structures disclosed, it is not confined to the details set forth, but is intended to cover such modifications or changes as they come within the scope of the following claims.

What is claimed is:

1. A heat and pressure fusing system for fusing a toner image on a copy sheet having a leading and trailing edge comprising:

a rotatable heated fuser roll, a thin web in pressure contact with the fuser roll along a wrap angle of less than 70° of the total arc circumference of the fuser roll, said wrap angle defining the area in which the toner image is fused, and web biasing means for maintaining the web in contact with the roll surface at at least two pressure differentials along said wrap angle area, said fusing system further including an entrance nip formed at the roll and web interface for engaging the leading edge of the copy sheet and wherein said web biasing means includes a first flexible blade member mounted so as to apply a first biasing pressure to said web at a point beginning at said entrance nip and extending over an area A of the total wrap angle area, and a second flexible blade member mounted so as to apply a second biasing pressure to said web across an area B of the wrap angle area separated from area A and wherein said first and second pressures applied by said first and second blade members are within a pressure range of 16 to 22 pounds.

2. The fusing system of claim 1 wherein said second blade member includes a flexible blade having a high temperature, silicone, foam rubber pad mounted so as to contact the web over area B, said pad enlarging the contact area between web and roll and enhancing thermal stability.

3. The fusing system of claim 1 wherein said area B extends over 25° of the total wrap angle area.

4. The fusing system of claim 1 wherein the web is in contact with the fuser roll over a third area C intermediate areas A and B, the web held against the roller surface at a pressure which is less than that applied along areas A and B.

5. The fusing system of claim 1 wherein said web biasing means includes a pressure applying blade member having a resilient pad attached to one end, the pad having a width which extends over at least one third of the wrap angle, the interface area between the pad and the fuser roll being subjected to a pressure which is greater than that of the remainder of the fuser interface area.

6. The fusing system of claim 1 wherein said first and second blade members are mounted on a pivotable frame member, the frame member having a pivoting extrusion attached to a extension spring.

7. A large document copying machine in which a photoconductive member is rotated at a process speed of between 2 and 3 inches per second (ips), said photoconductive member having a width between 12 and 36 inches and passing through a plurality of xerographic stations including a large document exposure station, a developer station, a transfer station, and a fusing station, the fusing station comprising a heat and pressure fusing system for fusing a toner image on a copy sheet having a leading and trailing edge, said fusing system comprising:

a rotatable heated fuser roll, a thin web in pressure contact with the fuser roll along a wrap angle of less than 70° of the total arc circumference of the fuser roll, said wrap angle defining the area in which the toner image is fused, and web biasing means for maintaining the web in contact with the roll surface at at least two pressure differentials along said wrap angle area, said fusing system further including an entrance nip formed at the roll and web interface for engaging the leading edge of the copy sheet and wherein said web biasing means includes a first flexible blade member mounted so as to apply a first biasing pressure to said web at a point beginning at said entrance nip and extending over an area A of the total wrap angle area, and a second flexible blade member mounted so as to apply a second biasing pressure to said web across an area B of the wrap angle area separated from area A and wherein said first and second pressures applied by said first and second blade members are within a pressure range of 16 to 22 pounds.

* * * * *